US009889500B2

(12) United States Patent
Ikeda et al.

(10) Patent No.: US 9,889,500 B2
(45) **Date of Patent: *Feb. 13, 2018**

(54) DIE CASTING MACHINE AND CONTROL METHOD OF DIE CASTING MACHINE

(71) Applicant: TOYO MACHINERY & METAL CO., LTD., Akashi-shi, Hyogo (JP)

(72) Inventors: Shingo Ikeda, Akashi (JP); Akihiro Yamanaka, Akashi (JP); Yuji Harada, Akashi (JP)

(73) Assignee: TOYO MACHINERY & METAL CO., LTD., Akashi-shi (JP)

( * ) Notice: Subject to any disclaimer, the term of this patent is extended or adjusted under 35 U.S.C. 154(b) by 67 days.

This patent is subject to a terminal disclaimer.

(21) Appl. No.: 14/462,720

(22) Filed: Aug. 19, 2014

(65) Prior Publication Data

US 2014/0353340 A1 Dec. 4, 2014

Related U.S. Application Data

(63) Continuation of application No. PCT/JP2013/055810, filed on Mar. 4, 2013.

(30) Foreign Application Priority Data

Mar. 9, 2012 (JP) ..... 2012-053458

(51) Int. Cl.
*B22D 17/32* (2006.01)
*B22D 17/20* (2006.01)

(52) U.S. Cl.
CPC ..... *B22D 17/32* (2013.01); *B22D 17/203* (2013.01)

(58) Field of Classification Search
CPC ..... B22D 17/203; B22D 17/32; B22D 17/04; B22D 17/30; B22D 39/02
(Continued)

(56) References Cited

U.S. PATENT DOCUMENTS

2011/0114281 A1* 5/2011 Yukutomo ..... B22D 17/02 164/315
2017/0080489 A1* 3/2017 Ikeda ..... B22D 17/203

FOREIGN PATENT DOCUMENTS

JP 09-024530 A 1/1997
JP 10-328808 A 12/1998
(Continued)

OTHER PUBLICATIONS

International Search Report dated May 28, 2013, issued in corresponding application No. PCT/JP2013/055810.

*Primary Examiner* — Scott Kastler
*Assistant Examiner* — Michael Aboagye
(74) *Attorney, Agent, or Firm* — Oliff PLC

(57) ABSTRACT

A die casting machine and a control method for avoiding damage to devices by performing operation control of a hydraulic operating means and an electric servomotor, that are adapted as drive sources in an injection step, separately and not performing coordinate control. The die casting machine includes a tubular injection sleeve, an injection plunger, an electric servomotor and a hydraulic operating means that are used as a drive source of an injection step, and a control means which controls the electric servomotor and the hydraulic operating means separately, when injecting and filling the cavity of the mold, which has been closed, with the molten metal by the advancing of the injection plunger, during a low-speed injection step and a high-speed injection step which is performed at a higher speed than the low-speed injection step, in the injection step.

2 Claims, 5 Drawing Sheets

(58) Field of Classification Search
USPC ..... 222/596; 164/155.5, 457, 312, 314, 119, 164/120, 113, 315, 303, 306; 264/328.1, 264/328.7
See application file for complete search history.

(56) References Cited

FOREIGN PATENT DOCUMENTS

| | | | |
|---|---|---|---|
| JP | 2008-073708 | A | 4/2008 |
| JP | 2008-080364 | A | 4/2008 |

* cited by examiner

DIE CASTING MACHINE AND CONTROL METHOD OF DIE CASTING MACHINE

CROSS REFERENCE TO RELATED APPLICATION

This application is a continuation of International application No. PCT/JP2013/055810, filed on Mar. 4, 2013, the contents of which are incorporated herein by reference.

The present application is based on and claims priority of Japanese patent application No. 2012-053458 filed on Mar. 9, 2012, the entire contents of which are hereby incorporated by reference.

BACKGROUND OF THE INVENTION

Field of the Invention

The present invention relates to a die casting machine which injects and fills a mold with a molten metal supplied into an injection sleeve by advancing of an injection plunger, and a control method of the die casting machine.

Description of the Related Art

In a general die casting machine conventionally used, a metal material molten in a melting furnace is measured and scooped with a ladle for each shot, scooped molten metal is supplied to a supply port of an injection sleeve, and the molten metal is injected into and fills a cavity of a mold by an advance movement of an injection plunger provided inside the injection sleeve so as to be capable of advancing and retracting, so as to perform forming of a cast molded object.

An injection step of the die casting machine which injects the molten metal into the cavity of the mold includes a low-speed injection step and a high-speed injection step subsequent thereto. In the high-speed injection step, it is necessary to inject and fill the mold with the molten metal, at an injection speed of a high speed by one order of magnitude faster than an injection speed of an injection molding machine molding plastic products. Therefore, in the injection step, as a drive source for injecting and filling the cavity of the mold with the molten metal by the advance movement of the injection plunger, an electric servomotor is adopted as the drive source in the low-speed injection step, and on the other hand, a high-speed injecting and filling of the mold is performed in the high-speed injection step, by a hydraulic pressure drive source or by adding driving forces of the hydraulic pressure drive source and the electric servomotor, since larger driving force is necessary. As ones related to such technique, for example, JP-A-2008-73708 (Patent Document 1) discloses a control method of a die casting machine, which advances an injection plunger using an electric servomotor as a drive source in a low-speed injection step, and advances the injection plunger by a cooperation of drive sources of the hydraulic pressure drive source and the electric servomotor in a high-speed injection step.

However, in the conventional technique disclosed in Patent Document 1, the injecting and filling is performed by advancing the plunger rod by coordinating a hydraulic pressure control mechanism operated by a hydraulic pressure source and an advance-retract control mechanism using an electric servomotor as a drive source, in the high-speed injection step in which the operation is performed at extreme high speed. As such, in the high-speed injection step operated with the hydraulic pressure source having larger driving force than the electric servomotor as a main drive source, there were cases where the operation of the advance-retract control mechanism using the electric servomotor as the drive source cannot follow the operation of the hydraulic pressure control mechanism operated by the hydraulic pressure source, which makes it difficult to perform coordinate operation control, and also leads to a breaking of the advance-retract control mechanism.

SUMMARY OF THE INVENTION

The present invention has been made in view of the above-mentioned problem, and aims to provide a die casting machine capable of avoiding damaging devices, by performing operation control of a hydraulic operating means and an electric servomotor that are adapted as drive sources in an injection step individually and not performing coordinate control thereof, when performing the injection step of injecting and filling a cavity of a mold with a molten metal, and a control method of the die casting machine.

The present invention of a die casting machine is characterized by a die casting machine including a tubular injection sleeve to which a molten metal is supplied, and an injection plunger which advances and retracts inside the injection sleeve, in which an electric servomotor and a hydraulic operating means are used as a drive source for an injection step which injects and fills a cavity of a mold, which has been closed, with the molten metal by an advancing of the injection plunger, the die casting machine including: a control means which controls an operation of the electric servomotor and an operation of the hydraulic operating means separately, when injecting and filling the cavity of the mold, which has been closed, with the molten metal by the advancing of the injection plunger, during a low-speed injection step and during a high-speed injection step which is performed subsequent to the low-speed injection step and which is performed at higher speed than in the low-speed injection step, in the injection step.

The present invention of the die casting machine is characterized in that the low-speed injection step which is performed immediately before the high-speed injection step includes a low-speed constant speed injection step of operating the injection plunger at a constant speed, using only the hydraulic operating means as the drive source, and a low-speed accelerated injection step of accelerating the injection plunger until it reaches the constant speed, and the electric servomotor and the hydraulic operating means are operated concurrently, from a starting point at which the low-speed accelerated injection step starts to an end point at which the low-speed accelerated injection step ends, and the injection plunger is accelerated until the end point of the low-speed accelerated injection step by a composite driving force of the electric servomotor and the hydraulic operating means.

The present invention of the die casting machine is characterized in that a starting point of the low-speed constant speed injection step which is the end point of the low-speed accelerated injection step and which coincides with the end point, is a point which is capable of being set preliminarily as a setting position.

The present invention of a control method of a die casting machine is characterized by a control method of a die casting machine including an injection step of injecting and filling a cavity of a mold, which has been closed, with a molten metal by supplying the molten metal into a tubular injection sleeve, and advancing an injection plunger inside the tubular injection sleeve to which the molten metal is supplied, wherein an electric servomotor and a hydraulic operating means are used as a drive source, in an injection step of injecting and filling the cavity of the mold, which has been closed, with the molten metal by advancing the injection plunger, and an operation of the electric servomotor and an operation of the hydraulic operating means are controlled separately by a control means, during a low-speed injection step and during a high-speed injection step which is performed subsequently to the low-speed injection step and which is performed at a higher speed than the low-speed injection step, in the injection step.

The present invention of the control method of the die casting machine is characterized in that the low-speed injection step performed immediately before the high-speed injection step includes a low-speed constant speed injection step of operating the injection plunger at a constant speed, using only the hydraulic operating means as the drive source, and a low-speed accelerated injection step of accelerating the injection plunger until it reaches the constant speed, and the electric servomotor and the hydraulic operating means are operated concurrently, from a starting point at which the low-speed accelerated injection step starts to an end point at which the low-speed accelerated injection step ends, and the injection plunger is accelerated until the end point of the low-speed accelerated injection step by a composite driving force of the electric servomotor and the hydraulic operating means.

The present invention of the control method of the die casting machine is characterized in that a starting point of the low-speed constant speed injection step which is the end point of the low-speed accelerated injection step and which coincides with the end point, is a point which is capable of being set preliminarily as a setting position.

DETAILED DESCRIPTION OF THE PREFERRED EMBODIMENTS

Embodiments of the present invention will be explained below with reference to FIG. 1 through FIG. 5C. It goes without saying that the present invention is easily applicable to configurations other than those explained in the embodiments, in a range not deviating from the purpose of the invention.

Figure 1:
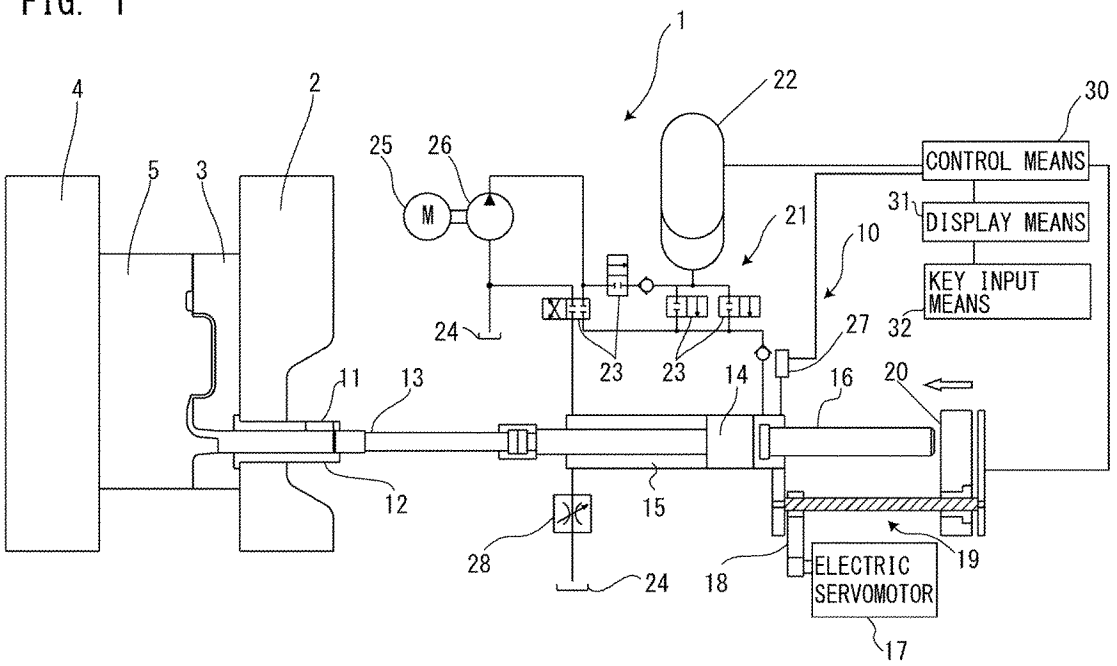
FIG. 1 is a configuration diagram showing an injection mechanism of a die casting machine of the present invention.

As is shown in FIG. 1, a die casting machine 1 is provided with an injection mechanism 10 for injecting and filling a cavity of a mold, which has been closed, with a molten metal, the mold consisting of a fixed mold 3 mounted on a fixed die plate 2 and a movable mold 5 mounted on a movable die plate 4.

The injection mechanism 10 is provided with a tubular injection sleeve 12 which is provided integrally with the fixed die plate 2 and which is formed with an inlet 11 at an upper portion thereof to which the molten metal is supplied, an injection plunger 13 provided so as to be capable of advancing and retracting inside the injection sleeve 12, an injection piston 14 provided integrally to a rear end portion of the injection plunger 13, and an injection cylinder 15 which holds the injection piston 14 so as to advance and retract freely.

Further, to rearward of the injection piston 14, there is arranged a piston type spool 16 which presses the injection piston 14 and advances the injection plunger 13, when injecting and filling the cavity of the mold with the molten metal supplied inside the injection sleeve 12. The piston type spool 16 is pressed and advanced, by an electric drive transmission plate 20 being advance operated by a drive transmission mechanism 19 including a drive transmission belt 18 and the like, using an electric servomotor 17 as a drive source. As is shown in FIG. 1, the piston type spool 16 is provided separately, and not being installed integrally with the electric drive transmission plate 20 or the injection piston 14. Although not shown, a load cell (pressure detecting means) for detecting a pressure generated when the electric drive transmission plate 20 presses the piston type spool 16 may be configured to a rear end portion of the piston type spool 16.

Further, the injection mechanism 10 is provided with a hydraulic operating means 21. The injection piston 14 inside the injection cylinder 15 is advanced and retracted by a hydraulic pressure of an accumulator (hereinafter referred to as ACC) 22 configured in the hydraulic operating means 21. To the hydraulic operating means 21, there are configured a control valve 23 which is arranged on an oil path connecting the ACC 22 with a first oil chamber of the injection cylinder 15, which is provided with a direction changing function and a flow rate controlling function, and which performs a hydraulic control for advancing the injection plunger 13 via the injection piston 14, a hydraulic pump 26 which is arranged on the oil path connecting the control valve 23 with a tank 24 and which is driven by a motor 25, a hydraulic flow control valve 28 as the control valve which is arranged on the oil path connecting a second oil chamber of the injection cylinder 15 with the tank 24, and a pressure sensor 27 which is arranged in the second oil chamber of the injection cylinder 15, and the like.

Further, to the die casting machine 1, there are configured a control means 30 which manages the control of the overall die casting machine, such as individually controlling the operation of the hydraulic operating means 21 by opening and closing of the control valves 23 and 28, the driving of the electric servomotor 17, and the like, on the basis of the detection result of the pressure detected by the load cell or the pressure sensor 27 and the like, a display means 31 for displaying a setting information of the die casting machine 1 and the like, and a key input means 32 for setting various numerical values displayed to the display means 31 to a desired numerical value, and the like.

Figure 2:
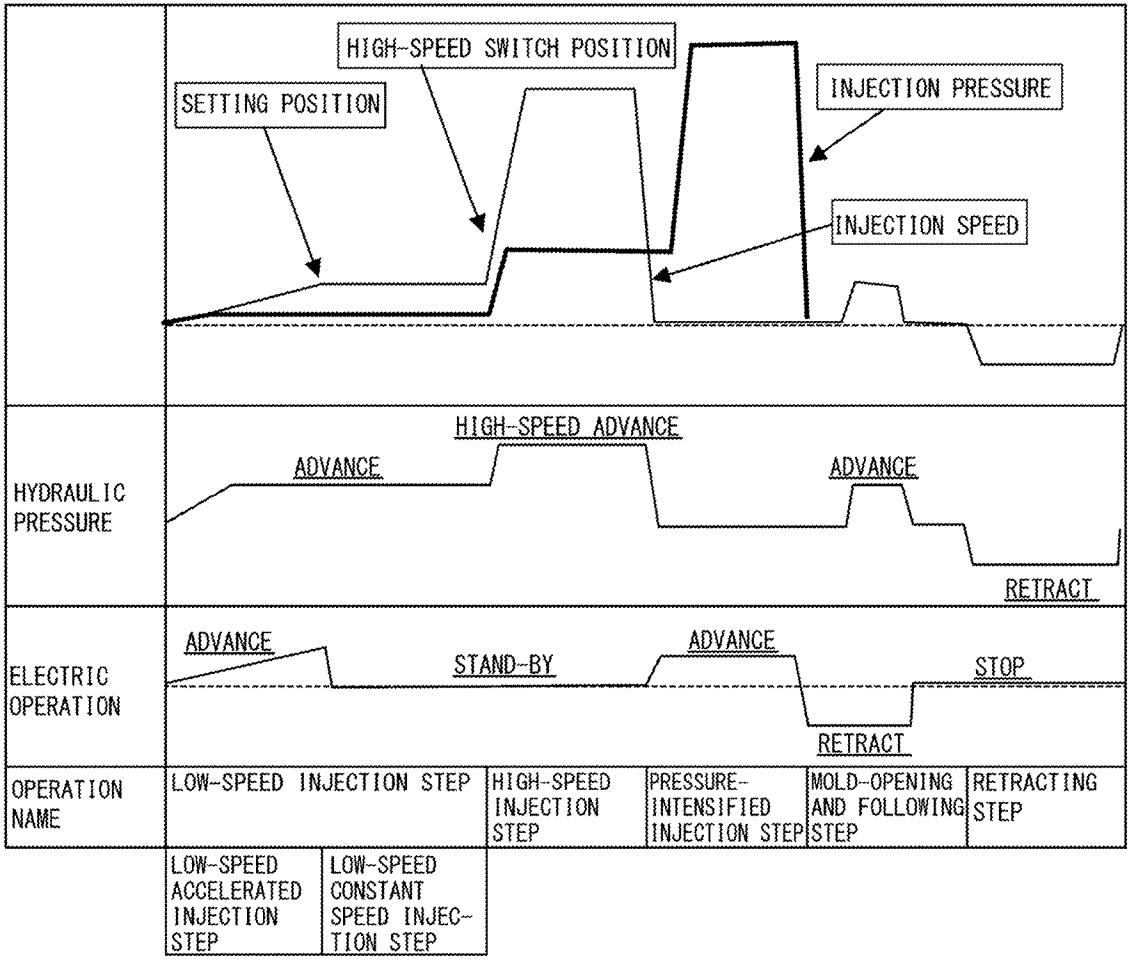
FIG. 2 is an explanatory view showing an ordinary injection operation when performing a low-speed injection step and a high-speed injection step in an injection step.
Figure 3:
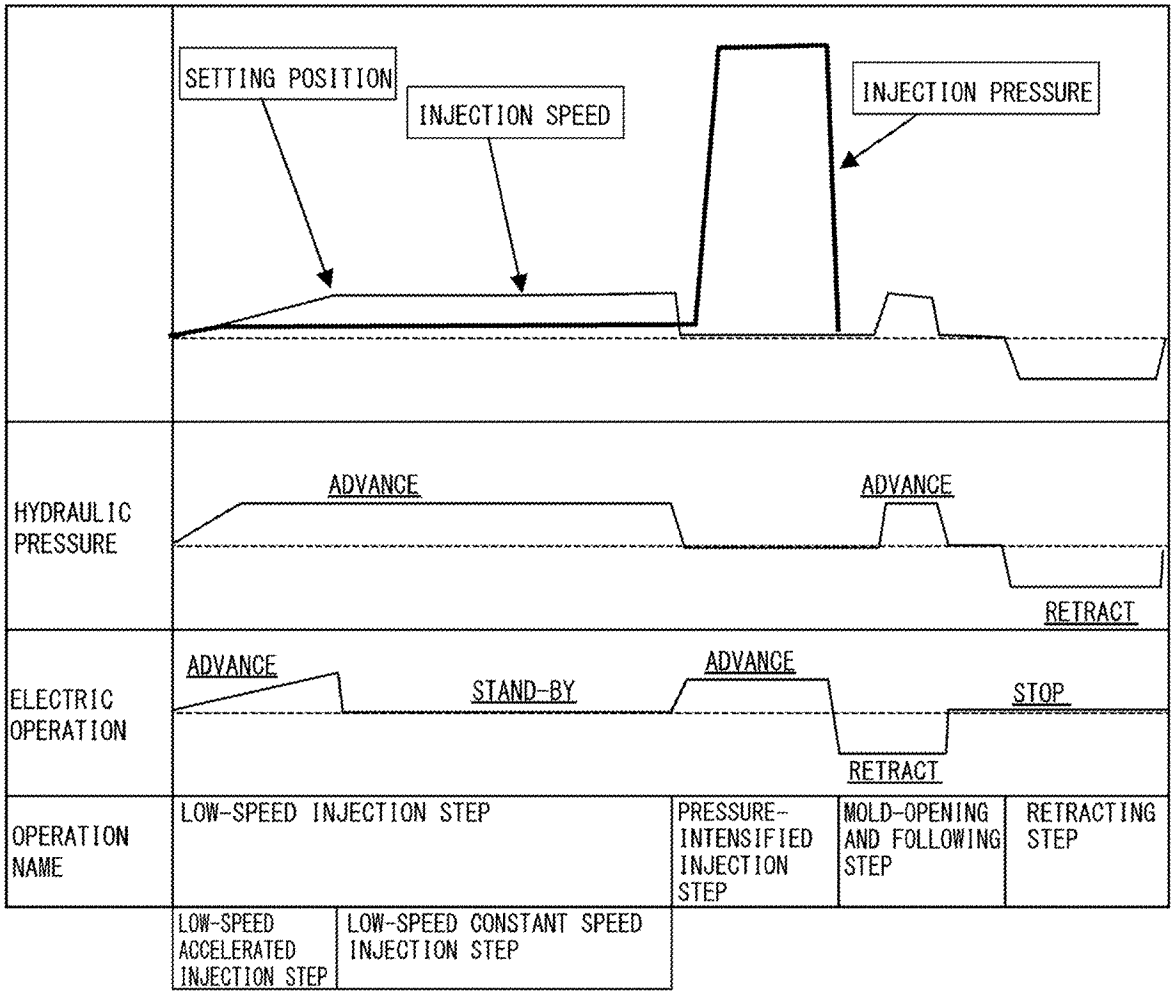
FIG. 3 is an explanatory view showing the low-speed injection operation which performs a low-speed constant speed injection step of the injection step using only the hydraulic operating means as the drive source, in a case where the high-speed injection step is not performed and only the low-speed injection step is performed.
Figure 4:
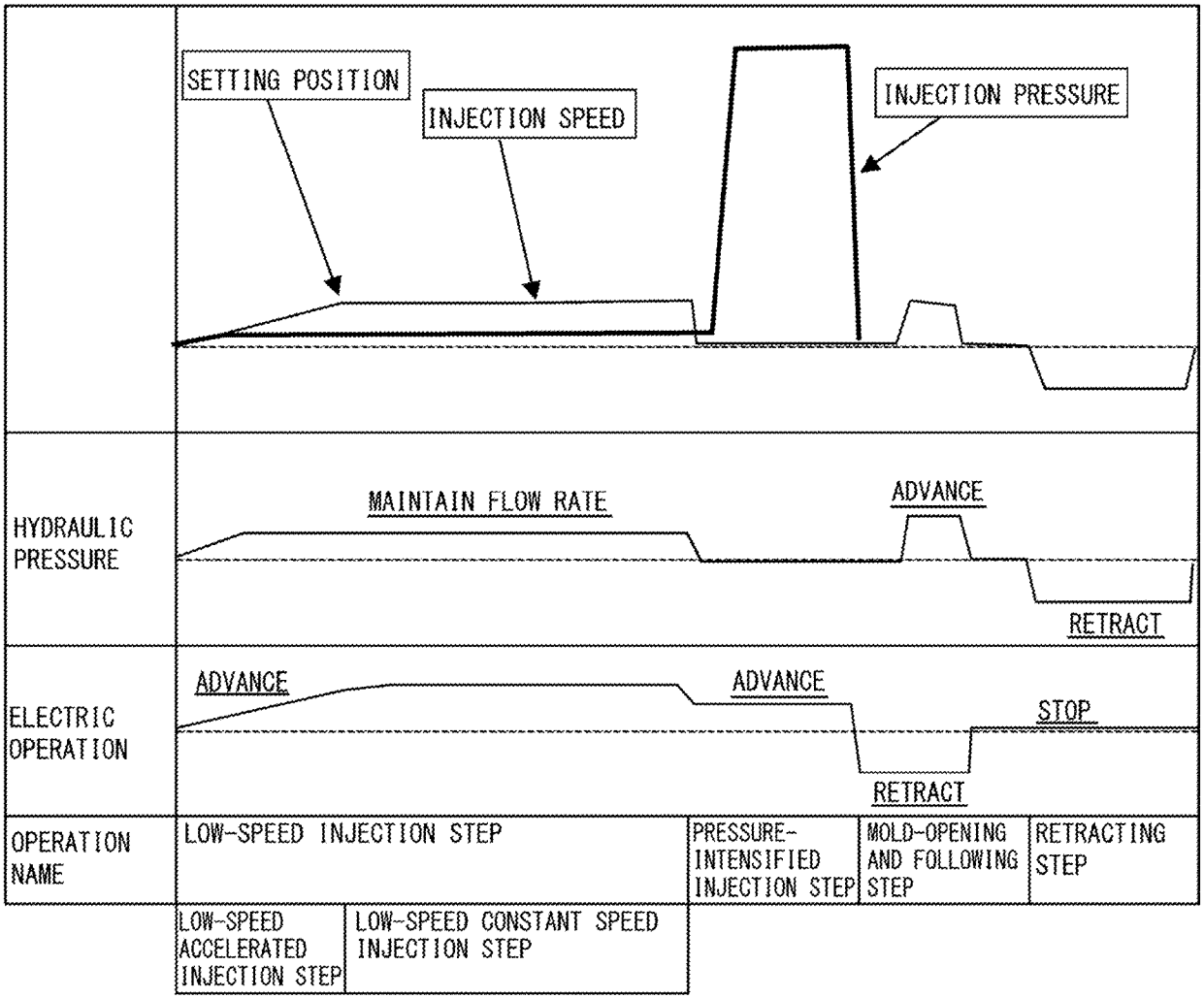
FIG. 4 is an explanatory view showing the low-speed injection operation which performs the low-speed constant speed injection step of the injection step using the hydraulic operating means and the electric servomotor as the drive source, in a case where the high-speed injection step is not performed and only the low-speed injection step is performed.

Explanation of a working example of the die casting machine 1 will be given with reference to FIG. 2 through FIG. 4. In FIG. 2 through FIG. 4, "injection pressure" is illustrated in thick line and "injection speed" is illustrated in thin line at an upper column, an operating state of the hydraulic operating means 21 is illustrated as "hydraulic pressure" at a middle column, and an operating state of the electric servomotor 17 is illustrated as "electric operation" at a bottom column.

In a working example shown in FIG. 2, as a series of molding steps for manufacturing a molded object, a low-speed injection step, a high-speed injection step, a pressure-intensified injection step, a mold-opening and following step, and a retracting step are performed in series. In the low-speed injection step, the hydraulic operating means 21 uses the ACC 22 as a hydraulic pressure drive source, and although acceleration is performed immediately after starting, advances the injection plunger 13 together with the injection piston 14 at a constant low-speed, and in the high-speed injection step subsequent thereto, advances the injection plunger 13 together with the injection piston 14 at high-speed, from a high-speed switch position from the low-speed injection step to the high-speed injection step. Further, the electric servomotor 17 as the electric drive source advances the injection plunger 13 together with the injection piston 14 at a low-speed with acceleration, in a low-speed accelerated injection step at an anterior half of the low-speed injection step, until reaching a preliminarily set setting position (a setting position determined in view of the state of the product being molded, and a position at which the state of the molten metal stabilizes) which is an end point of the low-speed accelerated injection step, and in a low-speed constant speed injection step at a latter half of the low-speed injection step, the electric servomotor 17 is made to stand-by as a preparation for the pressure-intensified injection step.

Subsequently, in the pressure-intensified injection step, the operation of the injection plunger 13 using the ACC 22 as the hydraulic pressure drive source is stopped and pressure is maintained, and on the other hand, the electric servomotor 17 as the electric drive source advances the injection plunger 13 together with the injection piston 14 at a constant speed.

After the pressure-intensified injection step is finished, the electric servomotor 17 as the electric drive source retracts the electric drive transmission plate 20 at a constant speed. On the other hand, after cooling of the product is finished, the mold-opening and following step is performed, and in the mold-opening and following step, a mold-opening operation of the movable mold 5 is performed, and in order to make an operation of removing the product adhered to the fixed mold 3 by ejection with the advancing operation of the injection plunger 13 to follow the mold-opening operation of the movable mold 5, the injection plunger 13 is advanced together with the injection piston 14, using the ACC 22 as the hydraulic pressure drive source.

Subsequently, as the retracting step, the injection piston 14 is retract operated using the ACC 22 as the hydraulic pressure drive source, the injection piston 14 is moved to a retractable limit at which the injection piston 14 was positioned at the start of the low-speed injection step, and accompanying thereto, the injection plunger 13 provided integrally with the injection piston 14 is also moved to the retractable limit.

Next, explanation will be given on an example of operation shown in FIG. 3. In the series of molding steps for manufacturing the molded object in FIG. 3, the high-speed injection step is not performed between the low-speed injection step and the pressure-intensified injection step, and the low-speed injection step, the pressure-intensified injection step, the mold-opening and following step, and the retracting step are performed in series.

In the low-speed injection step, the hydraulic operating means 21 uses the ACC 22 as the hydraulic pressure drive source, and although acceleration is performed immediately after starting, advances the injection plunger 13 together with the injection piston 14 at a constant low-speed. Further, the electric servomotor 17 as the electric drive source advances the injection plunger 13 together with the injection piston 14 at a low-speed with acceleration, in the low-speed accelerated injection step at the anterior half of the low-speed injection step, until reaching the preliminarily set setting position (the setting position determined in view of the state of the product being molded, and the position at which the state of the molten metal stabilizes) which is the end point of the low-speed accelerated injection step, and in the low-speed constant speed injection step at the latter half of the low-speed injection step, the electric servomotor 17 is made to stand-by as a preparation for the pressure-intensified injection step.

Subsequently, in the pressure-intensified injection step, the operation of the injection plunger 13 using the ACC 22 as the hydraulic pressure drive source is stopped and pressure is maintained, and on the other hand, the electric servomotor 17 as the electric drive source advances the injection plunger 13 together with the injection piston 14 at a constant speed.

After the pressure-intensified injection step is finished, the electric servomotor 17 as the electric drive source retracts the electric drive transmission plate 20 at a constant speed. On the other hand, after cooling of the product is finished, the mold-opening and following step is performed, and in the mold-opening and following step, a mold-opening operation of the movable mold 5 is performed, and in order to make an operation of removing the product adhered to the fixed mold 3 by ejection with the advancing operation of the injection plunger 13 to follow the mold-opening operation of the movable mold 5, the injection plunger 13 is advanced together with the injection piston 14, using the ACC 22 as the hydraulic pressure drive source.

Subsequently, as the retracting step, the injection piston 14 is retract operated using the ACC 22 as the hydraulic pressure drive source, the injection piston 14 is moved to a retractable limit at which the injection piston 14 was positioned at the start of the low-speed injection step, and accompanying thereto, the injection plunger 13 provided integrally with the injection piston 14 is also moved to the retractable limit.

Next, explanation will be given on an example of operation shown in FIG. 4. In the series of molding steps for manufacturing the molded object in FIG. 4, the high-speed injection step is not performed between the low-speed injection step and the pressure-intensified injection step, and the low-speed injection step, the pressure-intensified injection step, the mold-opening and following step, and the retracting step are performed in series. In the example of FIG. 4, the low-speed constant speed injection step is performed using (the ACC 22 of) the hydraulic operating means 21 and the electric servomotor 17 as the drive source.

In the low-speed injection step, the hydraulic operating means 21 uses the ACC 22 as the hydraulic pressure drive source, and although acceleration is performed immediately after starting, advances the injection plunger 13 together with the injection piston 14 at a constant low-speed. Further, the electric servomotor 17 as the electric drive source advances the injection plunger 13 together with the injection piston 14 at a low-speed with acceleration, in the low-speed accelerated injection step at the anterior half of the low-speed injection step, until reaching the preliminarily set setting position, and in the low-speed constant speed injection step at the latter half of the low-speed injection step, the electric servomotor 17 advances the injection plunger 13 together with the injection piston 14 at a constant low speed.

Subsequently, in the pressure-intensified injection step, the operation of the injection plunger 13 using the ACC 22 as the hydraulic pressure drive source is stopped and pressure is maintained, and on the other hand, the electric servomotor 17 as the electric drive source advances the injection plunger 13 together with the injection piston 14 at a constant speed which is slower than that during the low-speed accelerated injection step. Since the operation is performed using only the electric drive source and without using the hydraulic pressure drive source, the pressure detection is detected by a load cell or the like, not shown.

After the pressure-intensified injection step is finished, the electric servomotor 17 as the electric drive source retracts the electric drive transmission plate 20 at a constant speed. On the other hand, after cooling of the product is finished, the mold-opening and following step is performed, and in the mold-opening and following step, a mold-opening operation of the movable mold 5 is performed, and in order to make an operation of removing the product adhered to the fixed mold 3 by ejection with the advancing operation of the injection plunger 13 to follow the mold-opening operation of the movable mold 5, the injection plunger 13 is advanced together with the injection piston 14, using the ACC 22 as the hydraulic pressure drive source.

Subsequently, as the retracting step, the injection piston 14 is retract operated using the ACC 22 as the hydraulic pressure drive source, the injection piston 14 is moved to a retractable limit at which the injection piston 14 was positioned at the start of the low-speed injection step, and accompanying thereto, the injection plunger 13 provided integrally with the injection piston 14 is also moved to the retractable limit. The retracted position of the injection piston 14 is also regulated by the electric drive transmission plate 20.

Figure 5A:
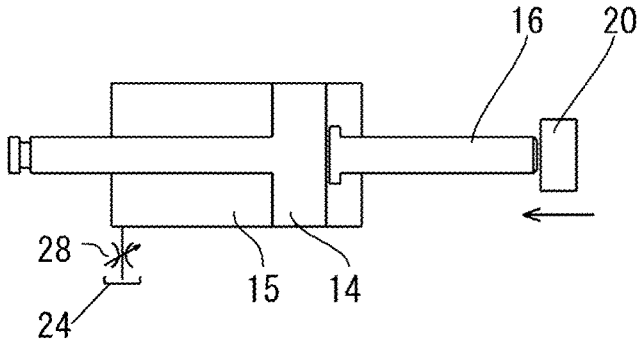
FIG. 5A is a schematic configuration view showing the injection mechanism of a die casting machine, and shows an example of an embodiment of the present invention.
Figure 5B:
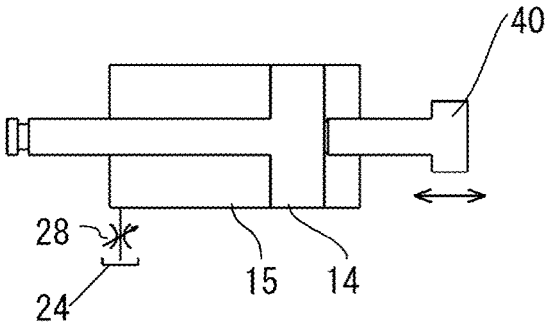
FIG. 5B is a schematic configuration view showing the injection mechanism of the die casting machine, and shows a variant.
Figure 5C:
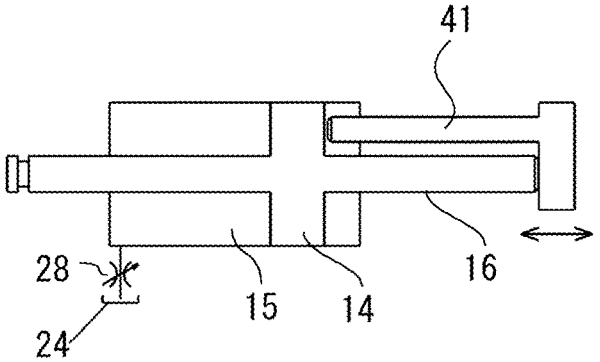
FIG. 5C is a schematic configuration view showing the injection mechanism of the die casting machine, and shows a variant.

The injection mechanism 10 of the die casting machine 1 will be explained further with reference to FIGS. 5A to 5C. The schematic configuration of the injection mechanism 10 of FIG. 5A corresponds to FIG. 1, and as is shown in FIG. 5A, the piston type spool 16 and the injection piston 14 are not integral and are arranged separately. Therefore, as is explained above, in the examples of FIG. 2 and FIG. 3, the injection plunger 13 together with the injection piton 14 are advanced at low speed with acceleration from a composite driving force from the cooperation of the hydraulic operating means 21 using the ACC 22 as the hydraulic pressure drive source and the electric servomotor 17 as the electric drive source in the low-speed accelerated injection step at the anterior half of the low-speed injection step. In the low-speed accelerated injection step, the piston type spool 16 presses the injection piston 14 and is in a contact state. However, in the low-speed constant speed injection step immediately thereafter and the high-speed injection step, the electric servomotor 17 is in the stand-by state, so that the injection piston 14, which had been in contact with the piston type spool 16 during the low-speed accelerated injection step, becomes out of contact with the piston type spool 16 and advances further. With such configuration, during the high-speed injection step, the injection plunger 13 is not coordinated and operated by the cooperation of the two drive sources of the hydraulic operating means 21 and the electric servomotor 17, but is configured so that the two may be controlled separately. Therefore, it becomes possible to prevent, for example, one drive source (the electric servomotor) being affected by the drive (the injection speed) of the other drive source (the hydraulic operating means), and the one drive source (the electric servomotor) being damaged such as malfunction accompanying an abnormal control. Further, as is shown in a modification in FIG. 5B, it is possible to operate the injection piston 14 provided integrally with the injection plunger 13, using the piston type spool itself as an electric spool 40, rather than a configuration of operating the piston type spool 16 with the electric drive transmission plate 20. Moreover, as is shown in a modification in FIG. 5C, the piston type spool 16 may be configured integrally to the injection piston 14, and the injection piston 14 with the piston type spool 16 configured integrally may be operated by an operation of a pressure-intensify exclusive spool 41 provided separately from the injection piston 14.

As is explained above, according to the die casting machine 1 of the present embodiment, the die casting machine 1 includes the tubular injection sleeve 12 to which a molten metal is supplied, and the injection plunger 13 which advances and retracts inside the injection sleeve 12, in which the electric servomotor 17 and (the ACC 22 of) the hydraulic operating means 21 are used as the drive source for the injection step which injects and fills the cavity of the mold, which has been closed, with the molten metal by the advancing of the injection plunger 13, and the die casting machine 1 includes the control means 30 which controls the operation of the electric servomotor 17 and the operation of the hydraulic operating means 21 separately, when injecting and filling the cavity of the mold, which has been closed, with the molten metal by the advancing of the injection plunger 13, during the low-speed injection step and during the high-speed injection step which is performed subsequent to the low-speed injection step and which is performed as higher speed than in the low-speed injection step, in the injection step. Further, as is shown in FIG. 2, the low-speed injection step which is performed immediately before the high-speed injection step includes the low-speed constant speed injection step of operating the injection plunger 13 at the constant speed using only the hydraulic operating means 21 as the drive source, and the low-speed accelerated injection step of accelerating the injection plunger 13 until it reaches the constant speed, and the electric servomotor 17 and (the ACC 22 of) the hydraulic operating means 21 are operated concurrently from the starting point at which the low-speed accelerated injection step starts to the end point at which the low-speed accelerated injection step ends, and the injection plunger 13 is accelerated from the starting point of the low-speed accelerated injection step until the end point of the low-speed accelerated injection step by the composite driving force of the electric servomotor 17 and (the ACC 22 of) the hydraulic operating means 21. When operating the die casting machine 1 and performing the injection step including the low-speed injection step or high-speed injection step of injecting and filling the cavity of the mold, which had been closed, with the molten metal, it is configured that the control means 30 performs operation control separately for the electric servomotor 17 and (the ACC 22 of) the hydraulic operating means 21. Therefore, when operating the electric servomotor 17 and (the ACC 22 of) the hydraulic operating means 21 concurrently during the injection step, and injecting and filling the cavity of the mold, which had been closed, with the molten metal by advancing the injection plunger 13 by the composite driving force therefrom, it becomes possible to prevent the one drive source (the electric servomotor) from being affected by the driving (the injection speed) of the other drive source (the hydraulic operating means) and the one drive source (the electric servomotor) from being damaged, since the hydraulic drive source and the electric drive source are not coordinated and controlled such as in the conventional technique. In the present embodiments, acceleration is continued by the composite driving forces of the electric servomotor 17 and (the ACC 22 of) the hydraulic operating means 21 from the starting point of the low-speed accelerated injection step to the end point of the low-speed accelerated injection step, however, the acceleration may be stopped not at the end but in the mid-course of acceleration. Further, by operating the low-speed accelerated injection step by the electric servomotor 17 and the hydraulic pressure drive source (the ACC 22), repetition stability is improved and the molded goods become stable. Further, by operating the pressure-intensified injection step using only the electric servomotor 17 as the drive source, a pressure feedback control and a multistage control during pressure-increase becomes possible, so that the quality of the molded goods may be improved. Still further, by positioning the retracted position of the electric drive transmission plate 20 with the electric servomotor 17, it becomes possible to vary the retracted position, and adjust the injection stroke.

The effects of the present invention are as follows.

According to the present invention, when working the die casting machine and performing the injection step including the low-speed injection step or the high-speed injection step of injecting and filling the cavity of the mold, which has been closed, with the molten metal, the control means performs the operation control of the electric servomotor and the hydraulic operating means separately. Therefore, when operating the electric servomotor and the hydraulic operating means concurrently during the injection step, and injecting and filling the cavity of the mold, which has been closed, with the molten metal by advancing the injection plunger by the composite driving force, it becomes possible to prevent the one drive source (the electric servomotor) from being affected by the driving (the injection speed) of the other drive source (the hydraulic operating means) and the one drive source (the electric servomotor) from being damaged, since the hydraulic pressure drive source and the electric drive source are not coordinated and controlled such as in the conventional technique. Further, by operating the low-speed accelerated injection step by the electric servomotor and the hydraulic pressure drive source, repetition stability is improved and the molded goods become stable.

What is claimed is:

1. A die casting machine comprising:

a tubular injection sleeve configured to receive a molten metal;

an injection plunger configured to advance and retract inside the injection sleeve, the advancing causing the injection plunger to inject and fill a cavity of a closed mold with the molten metal;

an electric servomotor and a hydraulic operator configured to independently drive the injection plunger; and a controller configured to control an operation of the electric servomotor and an operation of the hydraulic operator separately during low-speed injection and high-speed injection, and to:

perform the high-speed injection subsequent to the low-speed injection;

perform the high-speed injection at a higher speed than the low-speed injection;

during the low-speed injection, perform (i) low-speed constant speed injection that includes operating the injection plunger at a constant speed using only the hydraulic operator to drive the injection plunger, and (ii) low-speed accelerated injection that includes accelerating the injection plunger until the injection plunger reaches the constant speed; and control an operation of the electric servomotor and an operation of the hydraulic operator concurrently from a starting point at which the low-speed accelerated injection starts to an end point at which the low-speed accelerated injection ends in order to accelerate the injection plunger until the end point of the low-speed accelerated injection by a composite driving force of the electric servomotor and the hydraulic operator.

2. The die casting machine according to claim 1, wherein a starting point of the low-speed constant speed injection, which is the end point of the low-speed accelerated injection and which coincides with the end point, is set preliminarily as a setting position.

* * * * *